US005768958A

United States Patent [19]

Gamble

[11] Patent Number: 5,768,958

[45] Date of Patent: Jun. 23, 1998

[54] OPEN ENDED RACHET WRENCH

[76] Inventor: Bruce H. Gamble, Rt. 1, Box 173, Le Feria, Tex. 78559

[21] Appl. No.: 784,768

[22] Filed: Jan. 16, 1997

[51] Int. Cl.[6] ..... B25B 13/00

[52] U.S. Cl. ..... 81/58.2; 81/179

[58] Field of Search ..... 81/58, 58.2, 60, 81/179, 186, 126, 127

[56] References Cited

U.S. PATENT DOCUMENTS

| | | | |
|---|---|---|---|
| 1,308,440 | 7/1919 | Morrison | 81/179 |
| 2,592,781 | 4/1952 | Yavner | 81/179 |
| 2,700,315 | 1/1955 | Hermanson | 81/58.2 |
| 2,715,259 | 7/1955 | Cowell | 81/58.2 |
| 2,795,160 | 6/1957 | Blasdell | 81/179 |
| 2,879,681 | 3/1959 | Blasdell | 81/179 |
| 3,858,467 | 1/1975 | Evans | 81/179 |
| 4,440,047 | 4/1984 | Robbins | 81/179 |

FOREIGN PATENT DOCUMENTS

| | | | |
|---|---|---|---|
| 3229095 | 2/1984 | Germany | 81/60 |
| 1526121 | 9/1978 | United Kingdom | 81/179 |

*Primary Examiner*—D. S. Meislin
*Assistant Examiner*—Jani B. Danganan

[57] ABSTRACT

An open ended ratchet wrench comprises a head with an upper plate and a lower plate, the upper and lower plates being coupled together by a plurality of screws, the upper and lower plates each having an outboard end including a large recess extending therein, the recess and outboard end defining first and second arm members formed contiguously with a central region therebetween; the first arm of the upper plate including a generally rectangular shaped bore defining a first key track, the first key track including a first resilient device therein, a first key having a proximal end and an angled distal end, the first key being slidably positioned within the first key track and coupled to the first resilient device, the distal end extending outside the key track; the second arm including a second key track extending therethrough, a second key formed in a generally rectangular configuration with an angular interior end and an exterior end, the second key being slidably positioned within the second key track, the second key being coupled to a second resilient device.

9 Claims, 3 Drawing Sheets

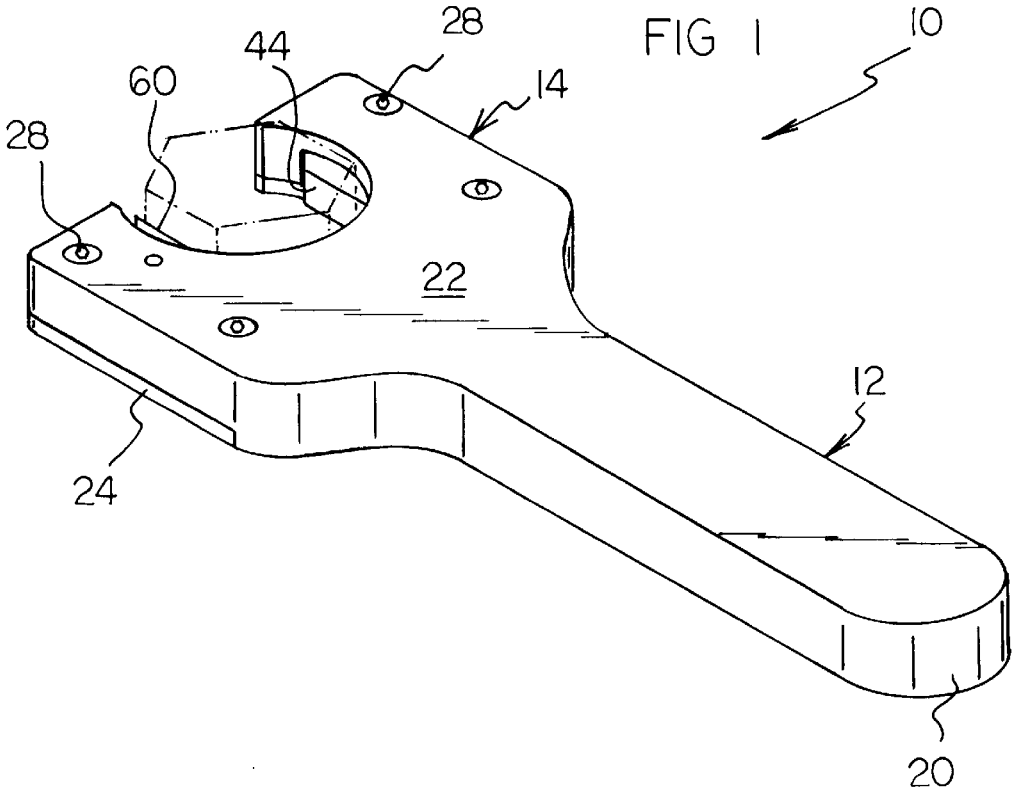
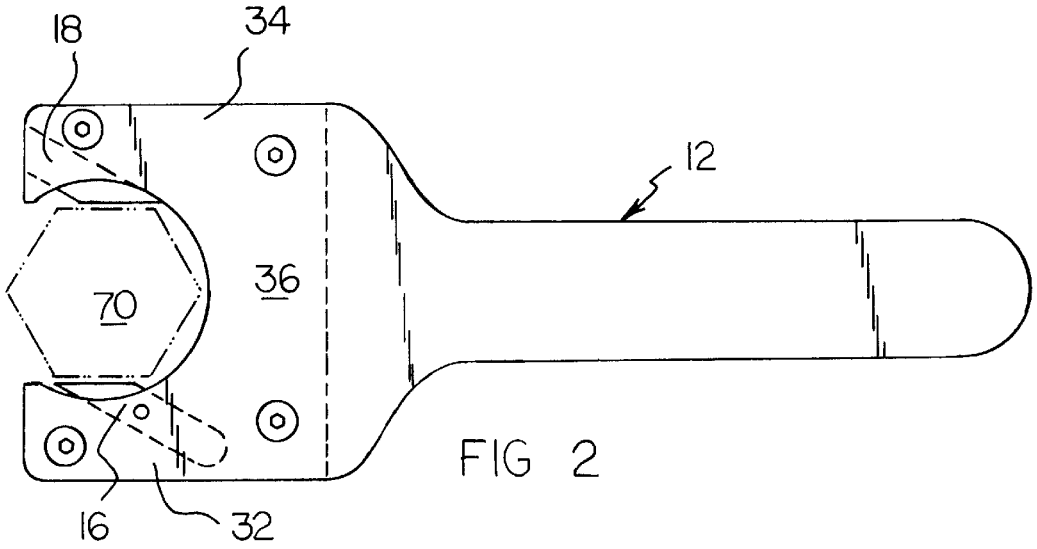
FIG 2

FIG 3
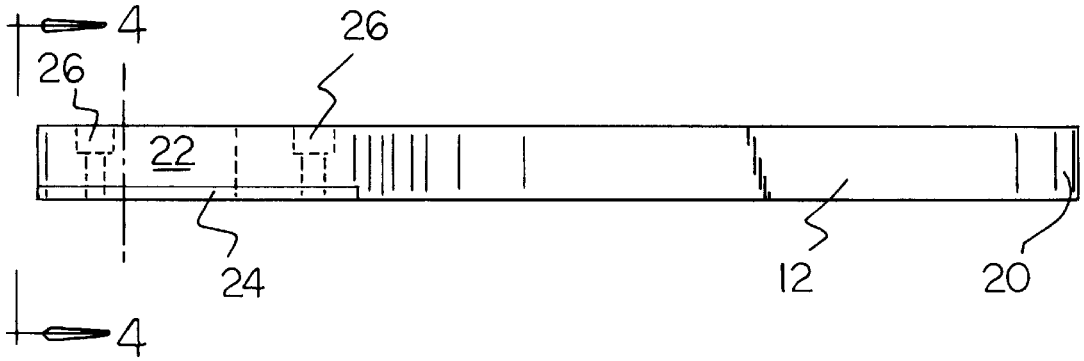
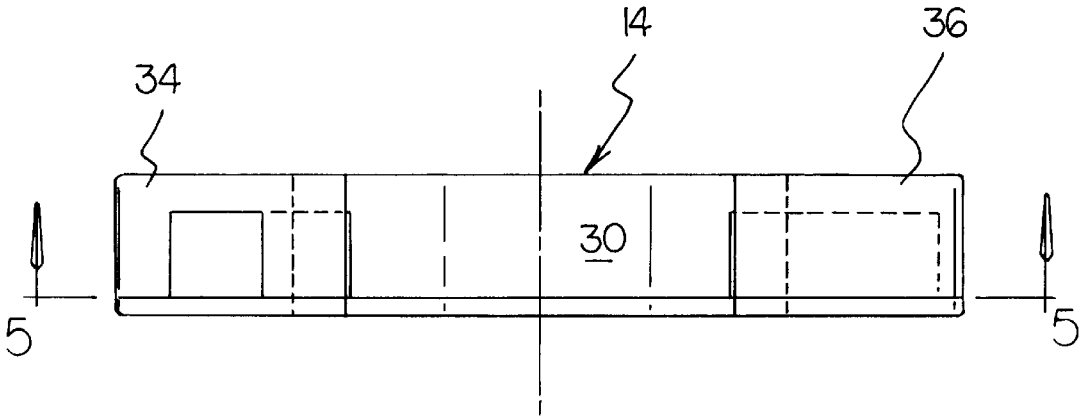
FIG 4

OPEN ENDED RACHET WRENCH

BACKGROUND OF THE INVENTION

1. Field of the Invention

The present invention relates to an open ended ratchet wrench and more particularly pertains to enabling users to loosen and tighten screws in hard to reach locations.

2. Description of the Prior Art

The use of ratchet wrenches is known in the prior art. More specifically, ratchet wrenches heretofore devised and utilized for the purpose of loosening and tightening screws are known to consist basically of familiar, expected and obvious structural configurations, notwithstanding the myriad of designs encompassed by the crowded prior art which have been developed for the fulfillment of countless objectives and requirements.

By way of example, U.S. Pat. No. 1,646,350 to A. De Hertelendy discloses a ratchet wrench.

U.S. Pat. No. 2,537,175 to W. Viets discloses a ratchet type socket wrench.

U.S. Pat. No. 2,691,315 to A. J. Brame discloses a open-end socket wrench.

U.S. Pat. No. 2,711,110 to A. J. Brame discloses a power driven open-end ratcheting wrench.

U.S. Pat. No. 2,712,259 to H. J. Cowell discloses an open ended ratchet wrench.

U.S. Pat. No. 3,067,641 to P. J. Ricci discloses a open ended ratchet wrench.

U.S. Pat. No. 3,448,641 to W. J. Morrow discloses a open end ratchet wrench with a removable head.

U.S. Pat. No. 4,631,990 to Hughes discloses an open-ended ratchet wrench.

U.S. Pat. No. 4,644,830 to Bailey, et al. discloses a ratchet wrench.

U.S. Pat. No. 5,282,830 to Reynolds discloses a open-ended ratchet wrench.

While these devices fulfill their respective, particular objective and requirements, the aforementioned patents do not describe an open ended ratchet wrench for enabling users to loosen and tighten screws in hard to reach locations.

In this respect, the open ended ratchet wrench according to the present invention substantially departs from the conventional concepts and designs of the prior art, and in doing so provides an apparatus primarily developed for the purpose of enabling users to loosen and tighten screws in hard to reach locations.

Therefore, it can be appreciated that there exists a continuing need for new and improved open ended ratchet wrench which can be used for enabling users to loosen and tighten screws in hard to reach locations. In this regard, the present invention substantially fulfills this need.

SUMMARY OF THE INVENTION

In the view of the foregoing disadvantages inherent in the known types of ratchet wrenches now present in the prior art, the present invention provides an improved open ended ratchet wrench. As such, the general purpose of the present invention, which will be described subsequently in greater detail, is to provide a new and improved open ended ratchet wrench and method which has all the advantages of the prior art and none of the disadvantages.

To attain this, the present invention essentially comprises a new and improved open ended ratchet wrench comprising, in combination: a handle formed in an elongated planar, generally rectangular shaped configuration with a rounded outboard end; a head formed in a planar generally rectangular shaped configuration with an upper plate and a lower plate, the upper plate having a greater length and thickness than the lower plate and being formed contiguously with the handle, the upper and lower plates each including four aligned hex screw holes extending therethrough, the upper and lower plates being coupled together by four hex screws, the upper and lower plates each having an outboard end including a large generally semicircular shaped recess extending therein, the recess and outboard end defining first and second arm members formed contiguously with a central region therebetween; the first arm of the upper plate including a generally rectangular shaped bore defining a first key track, the first key track being positioned at an angle of about one hundred twenty degrees with respect to the outboard end, the first key track having an inboard region and an outboard region, the inboard region including a resilient compression spring coupled therein, a first roll pin being coupled within the outboard region of the first key track, a first key being formed in a generally rectangular configuration with a flat proximal end and an angled distal end, the first key having a long side wall including a rectangular notch, the first key being slidably positioned within the first key track with the angled distal end extending outside the track, the proximal end of the first key being affixed to the compression spring, the notch of the first key being positioned around the first roll pin, the angled distal end being positioned at a ninety degree angle with respect to the outboard end of the first arm; the second arm of the upper plate including front and rear cylindrical holes extending therethrough, front and rear roll pins being positioned through the holes, an aperture defining a second key track extending through the second arm at an angle of about one hundred twenty degrees with respect to the outboard end of the second arm, a rectangular intermediate recess being formed within the second arm and being positioned adjacent to the second track, a cylindrical shaped interior bore formed in a generally oval configuration being positioned within the second arm adjacent to the intermediate recess, a second key formed in a generally rectangular configuration with an angular interior end and an exterior end, the second key being slidably positioned within the second key track, the front pin being perpendicularly coupled within the second key, a tension spring having front and rear hook members being coupled around the front and rear roll pins, the angled interior end being positioned at a ninety degree angle with respect to the outboard end of the second arm; and in an operative orientation a user positioning the semicircular recess around a bolt such that the distal end of the first key and the interior end of the second key engage the bolt, a user tightening a bolt by rotating the handle of the apparatus in a clockwise direction, a user loosening a bolt by rotating the handle in a counterclockwise direction.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved open ended ratchet wrench which has all the advantages of the prior art ratchet wrenches and none of the disadvantages.

It is another object of the present invention to provide a new and improved open ended ratchet wrench which may be easily and efficiently manufactured and marketed.

It is a further object of the present invention to provide a new and improved open ended ratchet wrench which is of durable and reliable construction.

An even further object of the present invention is to provide a new and improved open ended ratchet wrench which is susceptible of a low cost of manufacture with regard to both materials and labor, and which accordingly is then susceptible of low prices of sale to the consuming public, thereby making such an open ended ratchet wrench economically available to the buying public.

Even still another object of the present invention is to provide a new and improved open ended ratchet wrench for enabling users to loosen and tighten screws in hard to reach locations.

Lastly, it is an object of the present invention to provide a new and improved open ended ratchet wrench which comprises a head with an upper plate and a lower plate, the upper and lower plates each including a plurality of screw holes extending therethrough, the upper and lower plates being coupled together by a plurality of screws, the upper and lower plates each having an outboard end including a large recess extending therein, the recess and outboard end defining first and second arm members formed contiguously with a central region therebetween; the first arm of the upper plate including a generally rectangular shaped bore defining a first key track, the first key track including a first resilient device therein, a first key having a proximal end and an angled distal end, the first key being slidably positioned within the first key track and coupled to the first resilient device, the distal end extending outside the key track; the second arm including a second key track extending therethrough, a second key formed in a generally rectangular configuration with an angular interior end and an exterior end, the second key being slidably positioned within the second key track, the second key being coupled to a second resilient device; and in an operative orientation a user positioning the recess around a bolt such that the distal end of the first key and the interior end of the second key engage the bolt, a user tightening a bolt by rotating the handle of the apparatus in a clockwise direction, a user loosening a bolt by rotating the handle in a counterclockwise direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the open ended ratchet wrench constructed in accordance with the principles of the present invention.

FIG. 2 is a top perspective view illustrating the first and second keys of the apparatus.

FIG. 3 is a side perspective view of the apparatus illustrating the positioning of the hex screws.

FIG. 4 is a front view of the apparatus taken along section line 4—4 of FIG. 3.

The same reference numerals refer to the same parts through the various Figures.

DESCRIPTION OF THE PREFERRED EMBODIMENT

Figure 5:
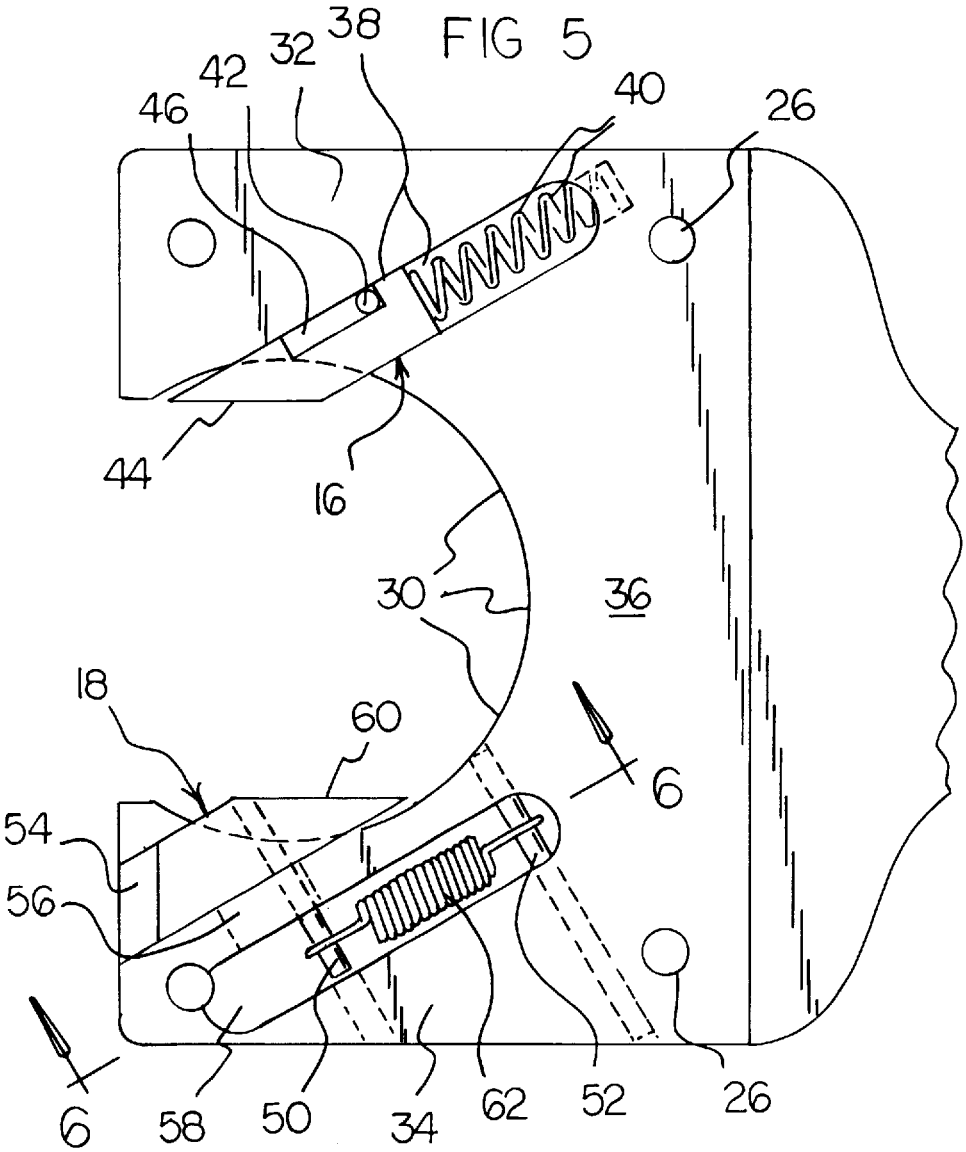
FIG. 5 is a bottom cross sectional view of the apparatus taken along section line 5—5 of FIG. 4.

With reference now to the drawings, and in particular, to FIG. 1 thereof, the preferred embodiment of the new and improved open ended ratchet wrench embodying the principles and concepts of the present invention and generally designated by the reference number 10 will be described.

Specifically, it will be noted in the various Figures that the device relates to an open ended ratchet wrench. In its broadest context, the device consists of a handle 12, a head 14 and first 16 and second 18 keys. Such components are individually configured and correlated with respect to each other so as to attain the desired objective.

The handle 12 is formed in an elongated planar, generally rectangular shaped configuration with a rounded outboard end 20. The rounded outboard end is designed to prevent injury to a user when rotating the handle during use. In the preferred embodiment of the apparatus the handle is fabricated of steel. In alternative embodiments of the apparatus the handle is rubberized or fabricated of another suitable material. Further alternative embodiments of the apparatus are fabricated without a handle. In such embodiments a cooperatively coupled tool may be utilized to rotate the head of the apparatus. Note FIG. 1 and 2.

The head 14 is formed in a planar generally rectangular shaped configuration with an upper plate 22 and a lower plate 24. The upper plate 22 has a greater length and thickness than the lower plate and is formed integral with the handle 12. The upper and lower plates each include four aligned screw holes 26 extending through the plates. The upper and lower plates are coupled together by four screws 28, preferably socket head screws. The upper and lower plates each have an outboard end which includes a large generally semicircular shaped recess 30. The recess and outboard end define first 32 and second 34 arm members which are formed contiguously with a central region 36 between them. Note FIGS. 1–4.

The first arm of 32 the upper plate includes a generally rectangular shaped bore defining a first key track 38. The first key track is positioned at an angle of about one hundred twenty degrees with respect to the outboard end. The first key track has an inboard region and an outboard region. The inboard region includes a resilient compression spring 40 coupled within it. A first roll pin 42 is coupled within the outboard region of the first key track. Note FIG. 5. Preferably, the first key track is positioned at an angle of between 100 and 135 degrees with respect to the outboard end.

The first key 16 is formed in a generally rectangular configuration with a flat proximal end and an angled distal end 44. The first key has a long side wall which includes a rectangular notch 46. The first key 16 is slidably positioned within the first key track 38. The angled distal end 44 extends outside of the track. The proximal end of the first key is affixed to the compression spring 40. The notch of the first key is positioned around the first roll pin. The angled distal end is positioned at a ninety degree angle with respect to the outboard end of the first arm. Note FIGS. 1 and 5.

The second arm 34 of the upper plate includes front and rear cylindrical holes extending through them. Front 50 and rear 52 roll pins are positioned through the holes. An aperture defines a second key track 54 which extends through the second arm at an angle of about one hundred and twenty degrees with respect to outboard end of the second arm. A rectangular intermediate recess 56 is formed within the second arm and is positioned adjacent to the second track 54. A cylindrical shaped interior bore 58 is formed in a generally oval configuration and positioned within the second arm adjacent to the intermediate recess. Note FIG. 5. As shown in such Figure, the second key track is positioned at an angle of between about 110 and 160 degrees with respect to the outboard end.

Figure 6:
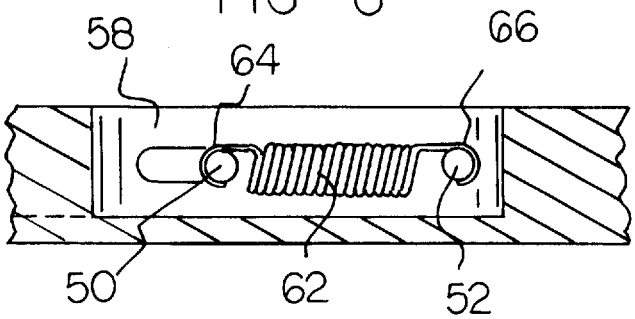
FIG. 6 is a cross sectional view of the apparatus taken along section line 6—6 of FIG. 5.

A second key 18 is formed in a generally rectangular configuration with an angular interior end 60 and an angled exterior end. The exterior end is angled at thirty degrees. The second key is slidably positioned within the second key track 54. The front pin 50 is perpendicularly coupled within the second key. A tension spring 62 has front 64 and rear 66 hook members which are coupled around the front 50 and rear 52 roll pins. The angled interior end 60 is positioned at a ninety degree angle with respect to the outboard end of the second arm. Note FIGS. 5 and 6. As shown in the various Figures, the ratio of the depth of the recess to the radius of the semicircular recess is about 1.5 to 1. Further, the ratio of the width of the head to the radius of the semicircular recess is about 2.3 to 1. As best shown in FIG. 2, the ratio of the width of the head to the length of the head is 3.5 to 1. Finally, it is preferred that the entire apparatus be fabricated of steel.

In an operative orientation a user positions the apparatus in his hand with the upper plate facing downward. The semicircular recess 30 is then positioned around a bolt 70 such that the distal end of the first key 44 and the interior end of the second key 60 engage the bolt 70. A user tightens the bolt by rotating the handle 12 of the apparatus in a clockwise direction. In this orientation the direction of the force exerted by the keys on the bolt is perpendicular to the key track. When the wrench is rotated in a counterclockwise direction, the keys retract thereby causing the tool to ratchet. Similarly, if the upper plate faces upward the tool will ratchet when rotated in a clockwise direction. In this orientation the direction of the force is parallel to the key track. The tension spring 62 functions to urge contact between the bolt and the second key. A user loosens the bolt 70 by turning the wrench upside down so that the upper plate faces upward and rotates the handle in a counterclockwise direction. The roll pin 42 limits the range of motion of the first key within the first key track by engaging the ends of the rectangular notch. Note FIGS. 1, 5 and 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved open ended ratchet wrench comprising, in combination:

a handle formed in an elongated planar, generally rectangular shaped configuration with a rounded outboard end;

a head formed in a planar generally rectangular shaped configuration with an upper plate and a lower plate, the upper plate having a greater length and thickness than the lower plate and being formed integral with the handle, the upper and lower plates each including four aligned hex screw holes extending therethrough, the upper and lower plates being coupled together by four hex screws, the upper and lower plates each having an outboard end including a large generally semicircular shaped recess extending therein, the recess and outboard end defining a first arm and a second arm formed contiguously with a central region therebetween;

the first arm of the upper plate including a generally rectangular shaped bore defining a first key track, the first key track being positioned at an angle of about one hundred twenty degrees with respect to the outboard end, the first key track having an inboard region and an outboard region, the inboard region including a resilient compression spring coupled therein, a first roll pin being coupled within the outboard region of the first key track, a first key being formed in a generally rectangular configuration with a flat proximal end and an angled distal end, the first key having a long side wall including a rectangular notch, the first key being slidably positioned within the first key track with the angled distal end extending outside the track, the proximal end of the first key being affixed to the compression spring, the notch of the first key being positioned around the first roll pin, the angled distal end being positioned at a ninety degree angle with respect to the outboard end of the first arm;

the second arm of the upper plate including front and rear cylindrical holes extending therethrough, front and rear roll pins being positioned through the holes, an aperture defining a second key track extending through the second arm at an angle of about one hundred twenty degrees with respect to the outboard end of the second arm, a rectangular intermediate recess being formed within the second arm and being positioned adjacent to the second track, a cylindrical shaped interior bore formed in a generally oval configuration being positioned within the second arm adjacent to the intermediate recess, a second key formed in a generally rectangular configuration with an angular interior end and an exterior end, the second key being slidably positioned within the second key track, the front pin being perpendicularly coupled within the second key, a tension spring having front and rear hook members being coupled around the front and rear roll pins, the angular interior end being positioned at a ninety degree angle with respect to the outboard end of the second arm; and in an operative orientation a user positioning the semicircular recess around a bolt such that the distal end of the first key and the interior end of the second key engage the bolt, a user tightening a bolt by rotating the handle of the apparatus in a clockwise direction, a user loosening a bolt by inverting the wrench and rotating the handle in a counterclockwise direction.

2. An open ended ratchet wrench comprising:

a head with an upper plate and a lower plate, the upper and lower plates each including a plurality of screw holes extending therethrough, the upper and lower plates being coupled together by a plurality of screws, the upper and lower plates each having an outboard end including a large recess extending therein, the recess and outboard end defining a first arm and a second arm formed contiguously with a central region therebetween;

the first arm of the upper plate including a generally rectangular shaped bore defining a first key track, the first key track including a first resilient device therein, a first key having a proximal end and an angled distal end, the first key being slidably positioned within the first key track and coupled to the first resilient device, the distal end extending outside the key track;

the second arm including a front roll pin and a rear roll pin each within respective cylindrical holes, a second key track extending therethrough, a second key formed in a generally rectangular configuration with an angular interior end and an exterior end, the second key being a rectangular intermediate recess adjacent the second key track, wherein the second key is coupled to the front roll pin and a tension spring is coupled to the front and rear roll pins; and in an operative orientation a user positioning the recess around a bolt such that the distal end of the first key and the interior end of the second key engage the bolt, a user tightening a bolt by rotating the handle of the apparatus in a clockwise direction, a user loosening a bolt by inverting the wrench and rotating the handle in a counterclockwise direction.

3. The open ended ratchet wrench as set forth in claim 2 and further including:

a handle formed in an elongated planar, generally rectangular shaped configuration with a rounded outboard end, the handle being formed integral with the upper plate of the head.

4. The open ended ratchet wrench as set forth in claim 3 wherein the head is formed in a generally rectangular configuration and the recess is formed in a generally semicircular configuration.

5. The open ended ratchet wrench as set forth in claim 4 wherein the ratio of the depth of the recess to the radius of the semicircular recess is about 1.5 to 1.

6. The open ended ratchet wrench as set forth in claim 4 wherein the ratio of the width of the head to the radius of the semicircular recess being about 2.3 to 1.

7. The open ended ratchet wrench as set forth in claim 4 wherein the ratio of the width of the head to the length of the head is about 3.5 to 1.

8. The open ended ratchet wrench as set forth in claim 3 wherein the first key track is positioned at an angle of between about one hundred and one hundred thirty five degrees with respect to the outboard end, the second key track being positioned at angle of between about one hundred ten and one hundred sixty degrees with respect to the outboard end.

9. The open ended ratchet wrench as set forth in claim 3 wherein the entire apparatus is fabricated of steel.

* * * * *